US007749675B2

(12) United States Patent
Lee et al.

(10) Patent No.: US 7,749,675 B2
(45) Date of Patent: Jul. 6, 2010

(54) METHOD OF PREPARING TONER AND TONER PREPARED USING THE METHOD

(75) Inventors: Jun-young Lee, Seoul (KR); Kyung-yol Yon, Seongnam-si (KR); Chang-kook Hong, Suwon-si (KR); Min-young Cheong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 524 days.

(21) Appl. No.: 11/604,298

(22) Filed: Nov. 27, 2006

(65) Prior Publication Data

US 2007/0166637 A1 Jul. 19, 2007

(30) Foreign Application Priority Data

Jan. 19, 2006 (KR) ..... 10-2006-0005851

(51) Int. Cl.
*G03G 9/087* (2006.01)

(52) U.S. Cl. ..... 430/137.17; 430/110.3

(58) Field of Classification Search ..... 430/109.3, 430/137.17, 109.1, 110.3
See application file for complete search history.

(56) References Cited

U.S. PATENT DOCUMENTS 6,132,919 A * 10/2000 Ogawa et al. ..... 430/108.8
2005/0130052 A1 6/2005 Tsunemi
2006/0088782 A1* 4/2006 Lee et al. ..... 430/137.11
2006/0142470 A1* 6/2006 Sato et al. ..... 524/556

FOREIGN PATENT DOCUMENTS

| | | | |
|---|---|---|---|
| CN | 1637631 A | | 7/2005 |
| JP | 2001-147550 | | 5/2001 |
| JP | 2003-122054 | | 4/2003 |
| WO | WO 2005/029196 | * | 3/2005 |

* cited by examiner

*Primary Examiner*—John L Goodrow
(74) *Attorney, Agent, or Firm*—Roylance, Abrams, Berdo & Goodman, L.L.P.

(57) ABSTRACT

A method of preparing a toner, including: preparing a colorant dispersion by mixing a reactive emulsifier and a colorant; preparing a toner composition by mixing a macromonomer including a hydrophilic group, a hydrophobic group and at least one reactive functional group, at least one polymerizable monomer and a chain transfer agent with the colorant dispersion; emulsion polymerizing the toner composition in a medium; and separating and drying the polymerized toner, wherein the amounts of the macromonomer and the chain transfer agent are controlled to regulate the configuration of toner particles. A toner prepared using the method, an image forming method using the toner, and an image forming apparatus using the toner are also provided by the invention. According to the method, the size and configuration of toner particles are easily controlled. In addition, the method minimizes the use of a surfactant, and decreases polluted water and waste water, which is very advantageous environmentally.

18 Claims, 2 Drawing Sheets

METHOD OF PREPARING TONER AND TONER PREPARED USING THE METHOD

CROSS-REFERENCE TO RELATED PATENT APPLICATION

This application claims the benefit under 35 U.S.C. §119 (a) of Korean Patent Application No. 10-2006-0005851, filed on Jan. 19, 2006, in the Korean Intellectual Property Office, the disclosure of which is hereby incorporated by reference in its entirety.

BACKGROUND OF THE INVENTION

1. Field of the Invention

The present invention relates to a method of preparing a toner and to the toner prepared using the method. More particularly, the invention relates to a method of preparing a toner by regulating the amounts of a reactive emulsifier and a macromonomer to control the configuration of toner particles, and the resulting toner. An image forming method using the toner, and an image forming apparatus employing the toner are also provided by the invention.

2. Description of the Related Art

In an electrophotographic process or an electrostatic recording process, a developer used to form an electrostatic image or an electrostatic latent image may be a two-component developer, formed of a toner and carrier particles, or a one-component developer, formed of a toner only. The one-component developer may be a magnetic one-component developer having magnetic properties or a nonmagnetic one-component developer having no magnetic properties. Plasticizers such as colloidal silica are often added independently into the nonmagnetic one-component developer to increase the flowability of the toner. Generally, coloring particles obtained by dispersing a colorant, such as carbon black, or other additives in a binding resin are used in the toner.

Methods of preparing toners include pulverization or polymerization. In pulverization, the toner is obtained by melt mixing synthetic resins with colorants and, if needed, other additives, pulverizing the mixture and sorting the particles until particles of a desired size of are obtained. In polymerization, a polymerizable monomer composition is manufactured by uniformly dissolving or dispersing a polymerizable monomer, a colorant, a polymerization initiator and, if needed, various additives such as a cross-linking agent and an antistatic agent. Next, the polymerizable monomer composition is dispersed in an aqueous dispersive medium which includes a dispersion stabilizer using an agitator to form minute liquid droplet particles. Subsequently, the temperature is increased and suspension polymerization is performed to obtain a polymerized toner having coloring polymer particles of a desired size.

In an image forming apparatus such as an electrophotographic apparatus or an electrostatic recording apparatus, an electrostatic latent image is formed through light-exposing the surface of a photoreceptor which is uniformly charged. A toner is attached to the electrostatic latent image, and a resulting toner image is transferred to a transfer medium such as a paper through several processes such as heating, pressing, solvent steaming, etc. In most fixing processes, the transfer medium with the toner image passes through fixing rollers and pressing rollers, and by heating and pressing, the toner image is fused to the transfer medium.

Images formed by an image forming apparatus such as an electrophotocopier should satisfy requirements of high precision and accuracy. Conventionally, a toner used in an image forming apparatus is usually obtained using pulverization of the toner material. When using pulverization, color particles having sizes in a large range are likely formed. Hence, to obtain satisfactory developer properties, there is a need to sort the coloring particles obtained through pulverization according to size to reduce the particle size distribution. However, it is difficult to precisely control the particle size distribution using a conventional mixing/pulverizing process in the manufacture of toner particles suitable for an electrophotographic process or electrostatic recording process. Also, when preparing a minute particle toner, a toner preparation yield is low due to a sorting process. In addition, there is a limit to a change/adjustment of a toner design for obtaining desirable charging and fixing properties. Accordingly, polymerized toners, in which the size of particles is easy to control and which do not need to go through a complex manufacturing process such as sorting, have come into the spotlight recently.

When a toner is prepared using polymerization, a desired particle size distribution is obtained without performing pulverization or classification.

U.S. Pat. No. 6,033,822 to Hasegawa et al. discloses a polymerized toner including a core formed of colored polymer particles and a shell covering the core in molecules, wherein the polymerized toner is prepared by suspension polymerization. However, it is still difficult to adjust the shape of the toner and the size of the particles using the process. Also, this process results in a wide particle size distribution.

U.S. Pat. No. 6,258,911 to Michael et al. discloses a bifunctional polymer having a narrow polydispersity and an emulsion-condensation polymerization process for manufacturing a polymer having covalently bonded free radicals on each of its ends. However, even when this method is used, a surfactant can cause an adverse effect, and it is difficult to control the size of the latex particles.

SUMMARY OF THE INVENTION

The present invention provides a method of preparing a toner where the method readily controls the size and the configuration or shape of toner particles. The method produces a toner having superior properties, such as storability, durability, and the like.

The present invention also provides a toner having excellent storability and durability, in which the particle size and configuration of the toner can be easily controlled.

The present invention also provides an image forming method in which a high quality image can be fused at a low temperature by using a toner having superior properties in particle size and configuration control, storability, and durability.

The present invention also provides an image forming apparatus in which a high quality image can be fused at a low temperature by using a toner having superior properties in particle size and configuration control, storability, and durability.

According to an aspect of the present invention, a method of preparing a toner, includes: preparing a colorant dispersion by mixing a reactive emulsifier and a colorant; preparing a toner composition by mixing a macromonomer including a hydrophilic group, a hydrophobic group, and at least one reactive functional group, at least one polymerizable monomer and a chain transfer agent with the colorant dispersion; emulsion polymerizing the toner composition in a medium; and separating and drying the polymerized toner, wherein the amounts of the macromonomer and the chain transfer agent are controlled to regulate the configuration of toner particles.

According to another aspect of the present invention, there is provided a toner is provided including an emulsion polymerized toner composition including a macromonomer containing a hydrophilic group, a hydrophobic group and at least one reactive functional group, at least one polymerizable monomer and a chain transfer agent in a colorant dispersion of a reactive emulsifier and a colorant, wherein the amounts of the macromonomer and the chain transfer agent are controlled to regulate the configuration of toner particles.

According to another aspect of the present invention, there is provided an image forming method including: forming a visible image by disposing toner formed using the above method on a photoreceptor surface where an electrostatic latent image is formed; and transferring the visible image to a transfer medium.

According to another aspect of the present invention, an image forming apparatus is provided including: an organic photoreceptor; an image forming unit to form an electrostatic latent image on a surface of the organic photoreceptor; a toner cartridge to contain the toner formed using the above method; a toner supplying unit to supply the toner to the surface of the organic photoreceptor to develop the electrostatic latent image on the surface of the organic photoreceptor into a toner image; and a toner transferring unit to transfer the toner image on the surface of the organic photoreceptor to a transfer medium.

According to the present invention, a toner having excellent storability and durability can be prepared. The particle size of the toner can be easily controlled. The toner is environmentally friendly and can be produced through simplified processes. Therefore, the production cost is low.

These and other aspects of the invention will become apparent from the following detailed description of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
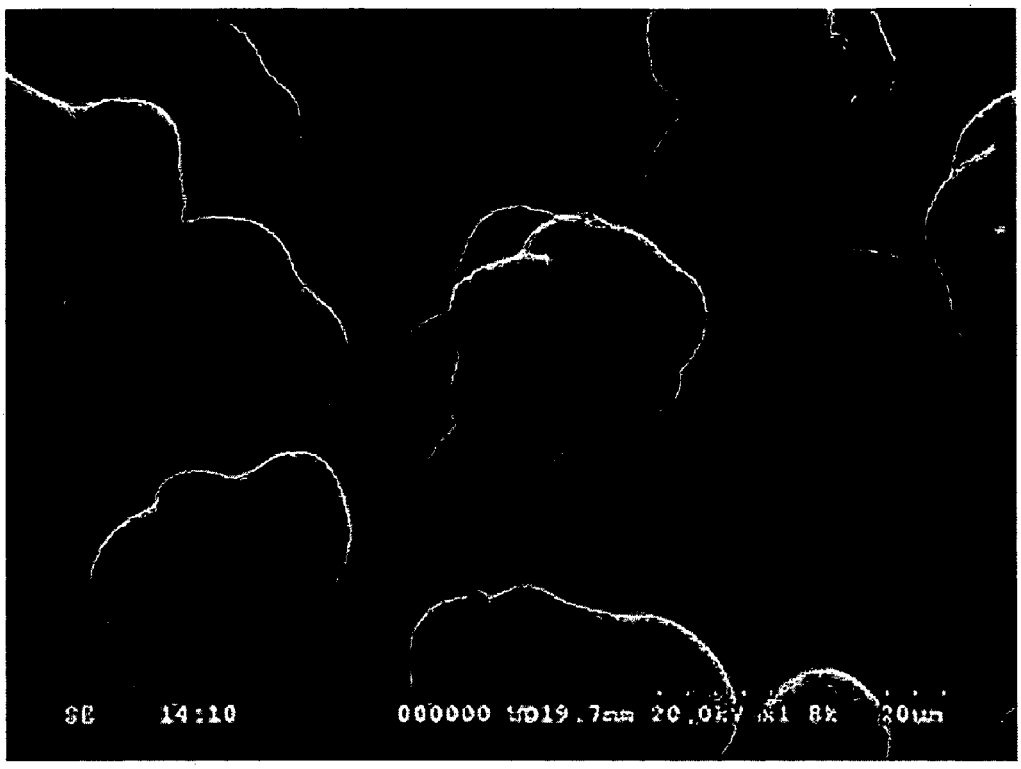
FIG. 1 is a photo of toner particles prepared using a method according to an embodiment of the present invention.

The present invention provides a method of preparing a toner including the steps of: preparing a colorant dispersion by mixing a reactive emulsifier and a colorant; preparing a toner composition by mixing a macromonomer, a polymerizable monomer and a chain transfer agent with the colorant dispersion; and emulsion polymerizing the toner composition.

The emulsion polymerizing the toner composition includes dispersing the colorant using the reactive emulsifier and polymerizing the resultant dispersion by adding a monomer, wax, and other toner components to prepare latex particles containing a colorant and wax. The latex particles are used in preparing the toner to minimize negative effects of the remaining emulsifier on the toner properties.

The dispersing of the colorant does not involve the use of a conventional emulsifier, but involves the use of a reactive emulsifier. Hence, the reactive emulsifier anchors to latex resins during a particle configuration reaction, thereby improving the properties of the toner since there is no migration of the remaining emulsifier in the toner.

The emulsion polymerizing of the toner composition does not involve the use of a conventional emulsifier, so that a cleaning process during separation and filtration processes of the toner particles prepared after the reaction is minimized. By minimizing the cleaning process, the preparation process is simplified and the production costs can be reduced. Also, by reducing polluted water and waste water, the method is very advantageous environmentally. In addition, problems such as low triboelectric charge, image deterioration can be prevented, and the storage stability of the toner can be improved remarkably.

The reactive emulsifier may include a polyoxyethylene alkylphenyl ether moiety and at least one anionic reactive emulsifier having a reactive group selected from the group consisting of a vinyl group, an acrylate group and a methacrylate group.

The weight average molecular weight of the reactive emulsifier may be in the range of about 100 to 1,000. When the weight average molecular weight of the reactive emulsifier is less than 100, the function of the reactive emulsifier as an emulsifier deteriorates. When the weight average molecular weight of the reactive emulsifier is greater than 1,000, the reactivity is low.

The amount of the reactive emulsifier may be in the range of about 5 to 50 parts by weight, and preferably in the range of about 10 to 20 parts by weight based on 100 parts by weight of the colorant. When the amount of the reactive emulsifier is less than 5 parts by weight, dispersibilities of the colorant and latex, and particle configuration rate are low. When the amount of the reactive emulsifier is greater than 50 parts by weight, reactivity of the reactive emulsifier to a monomer deteriorates.

The method of preparing the toner according to an embodiment of the present invention will now be described in detail. A reactive emulsifier and a colorant are mixed with ultra-high pure water and the resultant mixture is dispersed using a disperser to prepare a dispersed colorant solution. An ultrasonic homogenizer, a bead milling machine, or a microfluidizer may be used to disperse the colorant. The dispersed colorant solution is injected into a reactor and stirred after the reactor is purged with an appropriate amount of water and nitrogen gas. The degree of ionization of a reactive medium is controlled by the addition of an electrolyte such as NaCl or ion salt. When the temperature inside the reactor reaches an appropriate value, an organic solvent, which is a mixture of at least one polymerizable monomer and a macromonomer, is injected to the reactor semicontinuously. The amount and the time of injection of each material are controlled according to the reaction time of the monomer and macromonomer. The injected monomer diffuses from the center of the dispersed colorant solution and the particles of the dispersed colorant solution swell to form droplets of monomers containing colorants. When the particles of the dispersed colorant solution properly swell, a water soluble free radical initiator may be injected in the reactor to initiate a radical reaction.

The configuration of the toner particles changes due to the difference of the type and amount of an injected macromonomer to the toner composition according to the properties of the macromonomer. Also, dispersing the colorant involves the use of a reactive emulsifier. Hence the properties of the toner improve since there is no migration of the remaining emulsifier in the toner for particle configuration. Accordingly, a cleaning process is minimized. By minimizing the cleaning process, the preparation process is simplified and the production costs can be reduced. Also, by reducing polluted water and waste water, the method is very advantageous environmentally. In addition, problems such as low triboelectric charge, image deterioration can be prevented, and the storage stability of the toner can be improved remarkably.

The macromonomer according to an embodiment of the present invention is an amphipathic material including both a hydrophilic group and a hydrophobic group, and a polymer or an oligomer including at least one reactive functional group. The hydrophilic group reacts with a medium to improve water dispersion of a monomer, and the hydrophobic group promotes the emulsion polymerization by existing on the surface of toner particles. The macromonomer can form a copolymer by binding with a polymerizable monomer in the toner composition in various ways, such as grafting, branching or cross-linking to improve physical properties of toner particles, such as durability, and the like.

The physical properties of toner particles may be used in controlling the configuration of toner particles. The amount of the injected macromonomer and the amount and concentration of the injected chain transfer agent are regulated to control the molecular weight of toner particles and the properties of the resin, and accordingly, the configuration of toner particles are controlled. The amount and concentration of the injected chain transfer agent may be about 0-20% based on the weight of the toner composition, and the configuration of toner particles can be controlled based on the addition rate of the amount and concentration of the injected chain transfer agent compared to each monomer. When the amount or concentration of the chain transfer agent decreases, the molecular weight of the resin increases and spherical shapes of the toner particles decrease during aggregating/melting. On the other hand, when the amount and concentration of the chain transfer agent increases, the molecular weight of the resin decreases and spherical shapes of the toner particles increase.

FIG. 1 is a photo of the configuration of toner particles prepared using the method according to the present invention. The toner particles have an oblong or potato-like configuration that is formed by regulating the amounts of a chain transfer agent and a macromonomer in the toner.

According to the method of the present invention, the molecular weight and configuration of toner particles can be regulated using a chain transfer agent. Also, the surface and configuration of toner particles can be variously regulated by adding a macromonomer. As described above, the macromonomer is an amphipathic material including both a hydrophilic group and a hydrophobic group, and at least one reactive functional group. Hence, the molecular weight and configuration of toner particles can be regulated through various ways of binding, such as grafting, branching or cross-linking, and the like.

The weight average molecular weight of the macromonomer is in the range of about 100 to 100,000, and preferably in the range of about 1,000 to 10,000. When the weight average molecular weight of the macromonomer is less than 100, the properties of the toner may not improve or the macromonomer may not operate properly as a stabilizer. Also, when the weight average molecular weight of the macromonomer is greater than 100,000, a reaction conversion rate may be low.

The macromonomer according to an embodiment of the present invention may be, but is not limited to, a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate.

The amount of the macromonomer used in an embodiment of the present invention may be in the range of about 1 to 50 parts by weight based on 100 parts by weight of the toner composition. When the amount of the macromonomer is less than 1 part by weight based on 100 parts by weight of the toner composition, the stability of the particle distribution is low, and when the amount of the macromonomer exceeds 50 parts by weight based on 100 parts by weight of the toner composition, the property of the toner deteriorates.

The polymerizable monomer used in an embodiment of the present invention may be a monomer including at least one unsaturated group selected from the group consisting of a vinyl monomer, a polar monomer having a carboxyl group, a monomer having an unsaturated polyester group and a monomer having a fatty acid group.

The polymerizable monomer may be formed of, but is not limited to, at least one material selected from the group consisting of styrene-based monomer such as styrene, vinyltoluene, and α-methylstyrene; acrylic acid and methacrylic acid; (meth)acrylic acid derivative such as methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, dimethylaminoethylmethacrylate; (meth)acrylic acid derivative of amide selected from the group consisting of acrylonitrile, methacrylonitrile, acrylamide and methacrylamide; ethylenically unsaturated monoolefin such as ethylene, propylene and butylene; halogenated vinyl such as vinyl chloride, vinylidene chloride and vinyl fluoride; vinyl ester such as vinyl acetate and vinyl propionate; vinyl ether such as vinyl methyl ether and vinyl ethyl ether; vinyl ketone such as vinyl methyl ketone and methyl isopropenyl ketone; vinyl compound having nitrogen such as 2-vinyl pyridine, 4-vinyl pyridine and N-vinyl pyrrolidone.

The amount of the polymerizable monomer used in an embodiment of the present invention is in the range of about 3 to 50 parts by weight based on 100 parts by weight of the toner composition. When the amount of the polymerizable monomer is less than 3 parts by weight based on 100 parts by weight of the toner composition, the yield is low. When the amount of the polymerizable monomer exceeds 50 parts by weight based on 100 parts by weight of the toner composition, the stability of the toner composition is low.

The medium used in an embodiment of the present invention may be an aqueous solution or a mixture of water and an organic solvent.

An amphipathic macromonomer can act not only as a comonomer but also as a stabilizer. The reaction between initial radicals and monomers forms oligomer radicals, and provides an in situ stabilizing effect. The initiator decomposed by heat forms a radical, reacts with a monomer unit in an aqueous solution to form an oligomer radical, and increases hydrophobicity of the oligomer radical. The hydrophobicity of the oligomer radical accelerates the diffusion inside the micelle, accelerates the reaction with polymerizable monomers and facilitates a copolymerization reaction with a macromonomer.

Owing to the hydrophilicity of an amphipathic macromonomer, a copolymerization reaction can more easily occur in the vicinity of the surface of the toner particles. The hydrophilic portion of the macromonomer located on the surface of the particle increases the stability of the toner particle by providing steric stability, and can control the particle size according to the amount or molecular weight of the injected macromonomer. Also, the functional group which reacts on the surface of the particle can improve the electric frictional properties of the toner.

Radicals in the toner composition are formed by the initiator, and the radical may react with the polymerizable monomer. The radical reacts with the polymerizable monomer and the reactive functional group of the macromonomer to form a copolymer.

Examples of the radical polymerized initiator include persulfates, such as potassium persulfate, ammonium persulfate, and the like; azo compounds, such as 4,4-azobis (4-cyanovaleric acid), dimethyl-2,2'-azobis (2-methylpropionate), 2,2-azobis (2-amidinopropane) dihydrochloride, 2,2-azobis-2-methyl-N-1,1-bis (hydroxymethyl)-2-hydroxyethylpropionamide, 2,2'-azobis (2,4-dimethylvaleronitrile), 2,2'-azobisisobutyronitrile, 1,1'-azobis (1-cyclohexanecarbonitrile), and the like; peroxides, such as methylethylperoxide, di-t-butylperoxide, acetylperoxide, dicumylperoxide, lauroylperoxide, benzoylperoxide, t-butylperoxide-2-ethylhexanoate, di-isopropylperoxydicarbonate, di-t-butylperoxyisophthalate, and the like. Also, an oxidation-reduction initiator, which is a combination of a polymerized initiator and a reducing agent, may be used.

A developer according to an embodiment of the present invention may include a colorant that may be carbon black or aniline black in the case of a black toner. Also, it is easy to produce a nonmagnetic color toner according to an embodiment of the present invention. In the case of a color toner, carbon black is used as a colorant for black, and a yellow colorant, a magenta colorant, and a cyan colorant are further included as colorants for the colors.

The yellow colorant may be a condensed nitrogen compound, an isoindolinone compound, an anthraquinone compound, an azo metal complex, or an aryl imide compound. For example, C.I. pigment yellow 12, 13, 14, 17, 62, 74, 83, 93, 94, 95, 109, 110, 111, 128, 129, 147, 168, 180, and others, may be used.

The magenta colorant may be a condensed nitrogen compound, anthraquinone, a quinacridone compound, a lake pigment of basic dye, a naphthol compound, a benzoimidazole compound, a thioindigo compound, or a perylene compound. For example, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, and others, may be used.

The cyan colorant may be a copper phthalocyanine compound or a derivative thereof, an anthraquinone compound, or a lake pigment of basic dye. For example, C.I. pigment blue 1, 7, 15, 15:1, 15:2, 15:3, 15:4, 60, 62, 66, and others, may be used.

These colorants may be used alone or in combinations of two or more types. A desired colorant is selected considering color, saturation, brightness, weatherability, and dispersability in a toner.

The amount of the colorant may be in the range of about 0.1 to 20 parts by weight based on the 100 parts by weight of a polymerizable monomer. The amount of the colorant is not particularly limited as long as it is sufficient to color the toner. When the amount of the colorant is less than 0.1 parts by weight, the coloring is insufficient. When the amount of the colorant exceeds 20 parts by weight, the production costs of the toner increases and the toner does not have enough triboelectric charge.

The toner composition according to an embodiment of the present invention may include at least one material selected from the group consisting of wax, a charge control agent, and a release agent.

The release agent protects a photoreceptor and prevents deterioration of developing properties, and thus may be used for obtaining a high quality image. A release agent according to an embodiment of the present invention may use a solid fatty acid ester material with high purity. For example, a low molecular weight polyolefin, such as low molecular weight polyethylene, low molecular weight polypropylene, low molecular weight polybutylene, and the like; paraffin wax; or a multifunctional ester compound, and the like, may be used. The release agent used in an embodiment of the present invention may be a multifunctional ester compound formed of an alcohol having at least three functional groups and carboxylic acid.

The charge control agent may be formed of a material selected from the group consisting of a salicylic acid compound containing a metal, such as zinc or aluminum, a boron complex of bisdiphenylglycolic acid, and silicate. More particularly, dialkyl salicylic acid zinc or borobis (1,1-diphenyl-1-oxo-acetyl potassium salt) may be used.

A suitable wax which provides a desired characteristic of the final toner compound may be used. The wax may be polyethylene wax, polypropylene wax, silicone wax, paraffin wax, ester wax, carnauba wax or metallocene wax, but is not limited thereto. The melting point of the wax may be in the range of about 50 to about 150° C. Wax components physically adhere to the toner particles, but do not covalently bond with the toner particles. The toner is fixed to a final image receptor at a low fixation temperature and has superior final image durability and antiabrasion property.

The polymerizing reaction may be performed for about 3 to 12 hours according to the temperature. Particles obtained as a product of the reaction are filtered, separated, and dried. At this time, an agglomeration process may be performed to control the particle size. An additive may be further added to the dried toner to be used in a laser printer. The average volumetric particle size of the toner prepared according to an embodiment of the present invention may be in the range of about 0.5 to 20 μm, and preferably, in the range of about 5 to 10 μm.

The present invention provides a toner obtained by emulsion-polymerizing a toner composition, the toner composition including the macromonomer having a hydrophilic group, a hydrophobic group and at least one reactive functional group, at least one polymerizable monomer in a colorant dispersion, and a chain transfer agent in a colorant dispersion of a reactive emulsifier and a colorant, wherein the amounts of the macromonomer and the chain transfer agent are controlled to regulate the configuration of the toner particles.

A radical formed by an initiator reacts with the polymerizable monomer, and the reactive functional group of the macromonomer, and may form a copolymer. The copolymer may be formed by copolymerizing at least one monomer selected from the group consisting of a vinyl monomer, a polar monomer having a carboxyl group, a monomer having an unsaturated polyester group and a monomer having a fatty acid group. The weight average molecular weight of the copolymer may be in the range of about 2,000 to 200,000.

The weight average molecular weight of the macromonomer may be in the range of about 100 to 100,000, and is preferably in the range of about 1,000 to 10,000. The macromonomer may be formed of, but is not limited to, a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate.

The average volumetric particle size of the obtained toner particles may be in the range of about 0.5 to 20 μm and preferably in the range of about 5 to 10 μm.

The toner composition may further include at least one material selected from the group consisting of wax, a charge control agent, and a release agent. The details thereof are as described above.

The present invention provides an image forming method including forming a visible image by disposing a toner on an photoreceptor surface where an electrostatic latent image is formed; and transferring the visible image to the transfer medium, wherein the toner contains a copolymer of a reactive emulsifier and a polymerizable monomer obtained by emulsion-polymerizing a toner composition, the toner composition including the macromonomer containing a hydrophilic group, a hydrophobic group and at least one reactive functional group and at least one polymerizable monomer in a colorant dispersion, wherein the colorant dispersion is a mixture of the reactive emulsifier and a colorant.

An electrophotographic image forming process includes a charging process, a light-exposing process, a developing process, a transferring process, a fusing process, a cleaning process, and an erasing process, which are series of processes to form an image on an image receptor.

In the charging process, the photoreceptor is covered with electric charges of a desired polarity, either negative or positive, by a corona or a charging roller. In the light-exposing process, an optical system, generally a laser scanner or an array of diodes, forms a latent image corresponding to a final visual image to be formed on an image receptor by selectively discharging the charging surface of the photoreceptor in an imagewise manner. Electromagnetic radiation (hereinafter, "light") may be infrared radiation, a visible ray, or ultraviolet radiation.

In the developing process, in general, the toner particles with suitable polarity contact the latent image on the photoreceptor, and typically, an electrically biased developer which has a potential with the same polarity as the toner is used. The toner particles move to the photoreceptor, selectively adhere to the latent image through static electricity, and form a toner image on the photoreceptor.

In the transferring process, the toner image is transferred from the photoreceptor to a desired final image receptor. Sometimes, an intermediate transferring element is used to effect the transfer of the toner image from the photoreceptor to the final image receptor.

In the fused process, the toner image is fused to the final image receptor by melting or softening the toner particles by heating the toner image on the final image receptor. Alternatively, the toner can be fixed to the final image receptor under high pressure while being heated or without heating. In the cleaning process, the toner particles remaining on the photoreceptor are removed. In the erasing process, an electric charge on the photoreceptor is exposed to light of a certain wavelength, and the electric charge is substantially decreased to a uniform low value. Consequentially, a residue of the latent image is removed and the photoreceptor is prepared for the next image forming cycle.

The present invention also provides an image forming apparatus including: an organic photoreceptor; a unit for charging the surface of the organic photoreceptor; an image forming unit to form an electrostatic latent image on a surface of the organic photoreceptor; a toner cartridge to contain a toner, a toner supplying unit to supply the toner to the surface of the organic photoreceptor to develop the electrostatic latent image into a toner image; and a toner transferring unit to transfer the toner image on the organic photoreceptor to a transfer medium. The toner used in the image forming apparatus contains a copolymer of a reactive emulsifier and a polymerizable monomer obtained by emulsion-polymerizing a toner composition, the toner composition including the macromonomer containing a hydrophilic group, a hydrophobic group and at least one reactive functional group and at least one polymerizable monomer in a colorant dispersion, and a chain transfer agent in a colorant dispersion of a reactive emulsifier and a colorant, wherein the amounts of the macromonomer and the chain transfer agent are controlled to regulate the configuration of toner particles.

Figure 2:
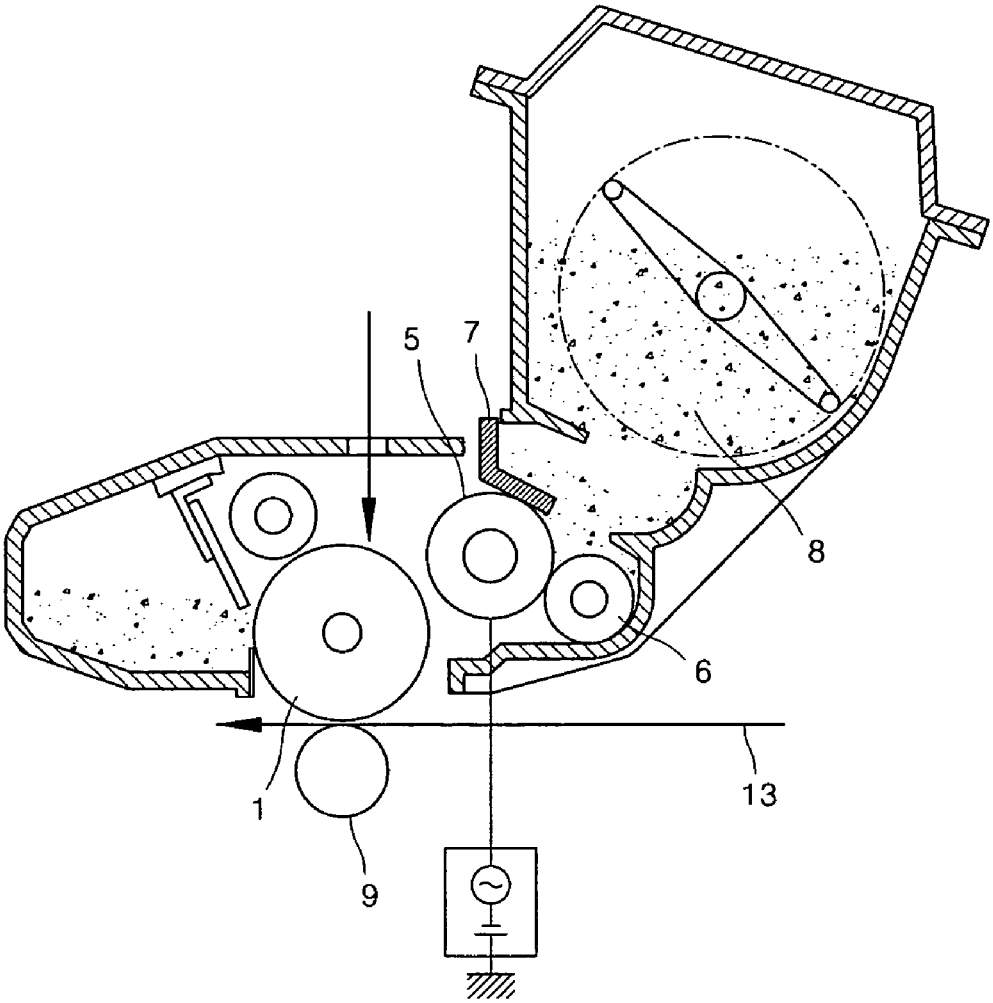
FIG. 2 is a schematic view of an image forming apparatus employing a toner prepared using a method according to an embodiment of the present invention.

FIG. 2 is a schematic diagram of a non-contact developing type image forming apparatus using a toner prepared using the method according to an embodiment of the present invention. The operating principles of the image forming apparatus are explained below.

A developer 8, which is a nonmagnetic one-component developer, is supplied to a developing roller 5 through a feeding roller 6 formed of an elastic material such as polyurethane form and sponge. The developer 8 supplied to the developing roller 5 reaches a contact point between the developing roller 5 and a developer regulation blade 7 as the developing roller 5 rotates. The developer regulation blade 7 is formed of an elastic material such as metal, rubber, and the like. When the developer 8 passes the contact point between the developing roller 5 and the developer regulation blade 7, the developer 8 is smoothed to form a thin layer that is sufficiently charged. The developing roller 5 transfers the thin layer of the developer 8 to a developing domain where thin layer of the developer 8 is developed on the electrostatic latent image of a photoreceptor 1, which is a latent image carrier.

The developing roller 5 and the photoreceptor 1 face each other with a constant distance therebetween. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between a voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9. The transferring device 9 receives a high voltage with an opposite polarity to the developer 8, and thus forms an image.

The image transferred to the printing paper 13 passes through a fusing device (not shown) that provides high temperature and high pressure, and the image is fused to the printing paper 13 as the developer 8 is fused to the printing paper 13. Meanwhile, the developer 8 remaining on the developing roller 5 and which is not developed is transferred back to the feeding roller 6 that contacts the developing roller 5. The above processes are repeated.

The present invention will now be described in greater detail with reference to the following examples. The following examples are for illustrative purposes only and are not intended to limit the scope of the invention.

EXAMPLES

Example 1

16 g of PB 15:3 as a cyan pigment and 4 g of BS-10 (available from DAI-ICHI KOGYO) as a reactive emulsifier were mixed in 100 g of ultra-high pure water deoxidized with ultra-high pure nitrogen, and the resultant mixture was rotated at 5,000 RPM for about an hour in a dispersing mixer (Dispermat Milling) to prepare a colorant dispersion. A monomer mixture of 75 g of styrene, 15 g of butylacrylate, and 5 g of methacrylate; 1 g of iso octyl mercapto propionate (IOMP) as a chain transfer agent; 3 g of polyethylene glycol methacrylate (PEG-MA) as a macromonomer; and 10 g of ester wax as a release agent were heated and mixed. At this time, the heating temperature did not exceed 60° C. An aqueous solution of 1 g of NaCl and 5 g of polyethylene glycol methacrylate dissolved and mixed in 500 g of ultra-high pure water was prepared and injected in a reactor. 50 g of the colorant dispersion obtained in the above process was diluted in 600 g of ultra-high pure water and injected to a 1-L reactor to be homogenized using a homogenizer. The homogenization was performed for two minutes at 7,000 RPM. The homogenized pigment solution was stirred at 300 RPM and heated to 80° C. When the internal temperature of the reactor reached an appropriate value, 1 g of potassium persulfate and 0.5 g of azoamide were added as an initiator, and the reactor was purged with nitrogen gas. Immediately, 100 g of a monomer compound of styrene, butylacrylate, methacrylate, and polyethylene glycol methacrylate at a ratio of 7:1.5:0.5:1 was slowly dropwise added to the reactor for about an hour. The reaction was performed for three hours, and after three hours, 2 g of NaCl dissolved in 20 g of ultra-high pure water was dropwise added to the reactor. 110 g of the monomer compound of above ratio was added to the reactor for an hour. At this time, the reaction was performed for six hours, and after the reaction was completed, the product was allowed to cool naturally. The average volumetric particle size of toner particles obtained through this process was 5.8 μm and the configuration of toner particles was irregular.

Example 2

A toner composition was prepared in the same manner as in Example 1 except that 2 g of IOMP as a chain transfer agent was used instead of 1 g, and 4 g of PEG-MA as a macromonomer was used instead of 3 g. The average volumetric particle size of toner particles obtained was 6.5 μm and the configuration of toner particles had an intermediate configuration of an irregular configuration and a potato-like configuration.

Example 3

A toner composition was prepared in the same manner as in Example 1 except that 3 g of IOMP as a chain transfer agent was used instead of 1 g, and 5 g of PEG-MA as a macromonomer was used instead of 3 g. The average volumetric particle size of toner particles obtained was 6.3 μm and the configuration of toner particles had a potato-like configuration. FIG. 1 is a photo of configuration of toner particles having a potato-like configuration.

Example 4

A toner composition was prepared in the same manner as in Example 1 except that 5 g of IOMP as a chain transfer agent was used instead of 1 g, and 5 g of PEG-MA as a macromonomer was used instead of 3 g. The average volumetric particle size of toner particles obtained was 6.2 μm and the configuration of toner particles had a spherical shape.

Example 5

A toner composition was prepared in the same manner as in Example 1 except that, 7 g of IOMP as a chain transfer agent was used instead of 1 g, and 5 g of PEG-MA as a macromonomer was used instead of 3 g. The average volumetric particle size of toner particles obtained was 6.1 μm and the configuration of toner particles had a spherical shape.

Example 6

A toner composition was prepared in the same manner as in Example 1 except that a chain transfer agent was not used. The average volumetric particle size of toner particles obtained was 6.5 μm and the configuration of toner particles was an agglomerate.

Comparative Example 1

Conventional Emulsion/Aggregation Process

Preparation of Latex 0.5 g of sodium dodecyl sulfate (SDS) as an anionic surfactant was mixed in 400 g of ultra-high pure water that was deoxidized. Styrene, butylacrylate, and methacrylic acid, which are monomers, were mixed together and put in a dropwise adding funnel. The aqueous solution was put into a reactor and heated to 80° C. When the temperature reached 80° C., a solution of 0.2 g of potassium persulfate, an initiator in 30 g of ultra-high pure water, was added. After 10 minutes, 30 g of a mixed monomer was dropwise added for about 30 minutes. After allowing a reaction to occur for 4 hours, the heating was stopped and the product was allowed to cool naturally. 30 g of the resultant seed solution was removed and added to 351 g of ultra-high pure water, and the result was heated to 80° C. 17 g of ester wax was heated and dissolved together with 18 g of monomer styrene, 7 g of butylacrylate, 1.3 g of methacrylic acid, and 0.4 g of dodecanethiol. The prepared wax/mixed monomer was added to 220 g of ultra-high pure water in which 1 g of SDS was dissolved, and the result was homogenized for about 10 minutes in an ultrasonic homogenizer. The homogenized emulsified solution was put into the reactor and after about 15 minutes, 5 g of the initiator and 40 g of ultra-high pure water were mixed and added to the reactor. During this time, the reaction temperature was maintained at 82° C. and the reaction was allowed to continue thereafter for about 2 hours and 30 minutes. After the reaction was performed for 2 hours and 30 minutes, 1.5 g of the initiator and 60 g of ultra-high pure water were again added together with a monomer for shell layer formation. The monomer was composed of 56 g of styrene, 20 g of butylacrylate, 4.5 g of methacrylic acid, and 3 g of dodecanethiol. The monomer was dropwise added to the reactor for about 80 minutes. After the reaction was performed for two hours, the reaction was stopped and the product was allowed to cool naturally.

Toner Aggregation/Melting Process 318 g of latex particles prepared as described above were mixed with ultra-high pure water in which 0.5 g of an SDS emulsifier was dissolved. 18.2 g of pigment particles (cyan 15:3, 40 solidity %) dispersed by the SDS emulsifier were added to obtain a latex pigment dispersed aqueous solution. While stirring the resultant product at 250 RPM, the pH of the latex pigment dispersed aqueous solution was titrated to pH 10 using a 10% NaOH buffer solution. 30 g of ultra-high pure water was dissolved in 10 g of $MgCl_2$ as an aggregating agent, and the result was dropwise added to the latex pigment aqueous solution for about 10 minutes. The temperature of the result was increased to 95° C. at a rate of 1° C./min. After about 3 hours of heating, the reaction was stopped and the product was allowed to cool naturally. The average volumetric particle size was about 6.5 μm.

The results of above examples are shown in Table 1 below.

TABLE 1

| Examples | Amount of chain transfer agent | Amount of macromonomer (PEG-MA) | Molecular weight | Configuration of toner particles |
|---|---|---|---|---|
| Example 1 | 1 | 3 | 100,000-500,000 | Irregular |
| Example 2 | 2 | 4 | 50,000-100,000 | Intermediate |
| Example 3 | 3 | 5 | 40,000-50,000 | Potato-like |
| Example 4 | 5 | 5 | 20,000-40,000 | Spherical |
| Example 5 | 7 | 5 | 20,000 | Spherical |
| Example 6 | 0 | 3 | 500,000-1,000,000 | Agglomerate |
| Comparative Example 1 | 0 | 0 | 30,000-100,000 | Potato-like |

According to the above results, as the amount of the chain transfer agent increased, the configuration of toner particles had a more spherical shape and the molecular weight decreased. Also, as the amount of the macromonomer increased, the molecular weight decreased, and the configuration of toner particles became almost spherical due to the chain transfer agent.

According to the present invention, the configuration and size of toner particles can be easily controlled, a cleaning process is simplified due to the use of a reactive emulsifier, and the generation of polluted water and waste water is decreased, which is very advantageous environmentally. The anti-offset properties, triboelectric charge properties and storage stability of the toner are superior and allow the realization of high quality images. Also, a toner with superior properties can be prepared under a high humidity condition.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of preparing a toner, comprising:

preparing a colorant dispersion by mixing a reactive emulsifier and a colorant;

preparing a toner composition by mixing a macromonomer including a hydrophilic group, a hydrophobic group, and at least one reactive functional group, at least one polymerizable monomer and a chain transfer agent with the colorant dispersion;

emulsion polymerizing the toner composition in a medium; and separating and drying the polymerized toner, wherein the amounts of the macromonomer and the chain transfer agent are controlled to change the configuration of toner particles from a potato shape to a spherical shape.

2. The method of claim 1, comprising adding the macromonomer in an amount effective to produce toner particles having a spherical shape.

3. The method of claim 1, comprising adding the chain transfer agent in an amount effective to produce toner particles having a spherical shape.

4. The method of claim 1, wherein the reactive emulsifier comprises a polyoxyethylene alkylphenyl ether moiety and at least one anionic reactive emulsifier having a group selected from the group consisting of a vinyl group, an acrylate group and a methacrylate group.

5. The method of claim 1, wherein the weight average molecular weight of the reactive emulsifier is in the range of about 100 to 1,000.

6. The method of claim 1, wherein the amount of the reactive emulsifier is in the range of about 5 to 50 parts by weight based on 100 parts by weight of the colorant.

7. The method of claim 1, wherein the weight average molecular weight of the macromonomer is in the range of about 100 to 100,000.

8. The method of claim 1, wherein the macromonomer is a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate, and polyester methacrylate.

9. The method of claim 1, wherein the amount of the macromonomer is in the range of about 1 to 50 parts by weight based on 100 parts by weight of the toner composition.

10. The method of claim 1, wherein the polymerizable monomer comprises at least one monomer selected from the group consisting of a vinyl monomer, a polar monomer having a carboxyl group, a monomer having unsaturated polyester, and a monomer having a fatty acid group.

11. The method of claim 1, wherein the polymerizable monomer comprises at least one material selected from the group consisting of a styrene-based monomer selected from the group consisting of styrene, vinyltoluene, and α-methylstyrene; acrylic acid; methacrylic acid; a (meth)acrylic acid derivative selected from the group consisting of methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, and dimethylaminoethylmethacrylate; a (meth)acrylic acid derivative of amide selected from the group consisting of acrylonitrile, methacrylonitrile, acrylamide and methacrylamide; an ethylenically unsaturated monoolefin selected from the group consisting of ethylene, propylene and butylene; a halogenated vinyl selected from the group consisting of vinyl chloride, vinylidene chloride and vinyl fluoride; a vinyl ester selected from the group consisting of vinyl acetate and vinyl propionate; a vinyl ether selected from the group consisting of vinyl methyl ether and vinyl ethyl ether; a vinyl ketone selected from the group consisting of vinyl methyl ketone and methyl isopropenyl ketone; and a vinyl compound having nitrogen selected from the group consisting of 2-vinyl pyridine, 4-vinyl pyridine and N-vinyl pyrrolidone.

12. The method of claim 1, wherein the colorant is a material selected from the group consisting of yellow, magenta, cyan and black pigments.

13. The method of claim 1, wherein the toner composition includes an initiator to provide a radical and where the radical reacts with the polymerizable monomer.

14. The method of claim 1, wherein the toner composition further comprises at least one material selected from the group consisting of wax, a charge control agent, and a release agent.

15. The method of claim 1, comprising including the macromonomer and chain transfer agent in amounts to produce substantially spherical shaped toner particles.

16. The method of claim 1, comprising including the macromonomer and chain transfer agent in amounts to produce toner particles having an oblong, potato shape.

17. The method of claim 1, wherein said toner particles have a particle size of about 0.5 to 20 μm.

18. The method of claim 1, wherein said toner particles have a particle size of about 5.0 to 10 μm.

* * * * *